US005320485A

United States Patent [19]

Bourguignon et al.

[11] Patent Number: 5,320,485

[45] Date of Patent: Jun. 14, 1994

[54] GUIDE VANE WITH A PLURALITY OF COOLING CIRCUITS

[75] Inventors: Anne E. F. Bourguignon, Brinville; Jacques A. A. Boury, Saint Ouen en Brie; Philippe J. Lefebvre, Chennevieres, all of France

[73] Assignee: Societe Nationale d'Etude et de Construction de Moteurs d'Aviation (S.N.E.C.M.A.), Paris, France

[21] Appl. No.: 74,403

[22] Filed: Jun. 10, 1993

[30] Foreign Application Priority Data

Jun. 11, 1992 [FR] France ..... 92 07008

[51] Int. Cl.[5] ..... F01D 9/02

[52] U.S. Cl. ..... 415/115; 415/116; 416/97 R

[58] Field of Search ..... 415/115, 116; 416/96 R, 416/96 A, 97 R

[56] References Cited

U.S. PATENT DOCUMENTS

| | | | |
|---|---|---|---|
| 2,896,907 | 7/1959 | Freche . | |
| 3,553,712 | 10/1970 | Kercher . | |
| 3,628,880 | 12/1971 | Smuland . | |
| 4,416,585 | 11/1983 | Abdel-Messeh . | |
| 5,117,626 | 6/1992 | North et al. | 416/96 R |

FOREIGN PATENT DOCUMENTS

| | | | |
|---|---|---|---|
| 59-122704 | 7/1984 | Japan . | |
| 204904 | 10/1985 | Japan | 415/116 |
| 194101 | 8/1991 | Japan | 416/96 R |
| 1268301 | 3/1972 | United Kingdom | 415/116 |

*Primary Examiner*—Edward K. Look
*Assistant Examiner*—James A. Larson
*Attorney, Agent, or Firm*—Bacon & Thomas

[57] ABSTRACT

A fluid cooled guide vane is disclosed for use in a gas turbine engine which defines a plurality of separate cooling circuits to guide a cooling fluid through the interior of the vane, while at the same time minimizing the pressure drop of the cooling fluid as it passes through the vane. Each cooling circuit has a cooling fluid inlet, a cooling fluid outlet, a cavity and a chamber which is in fluid communication with the cavity and either the fluid cooling inlet, or the fluid cooling outlet. The multiple chambers are located in mounting bases attached at either end of the vane. The mounting bases define the several chambers as well as the cooling fluid inlets. The cooling fluid outlets may either be defined by the mounting bases, or may be formed by rows of orifices through the vane wall in communication with the cavities within the vane.

5 Claims, 4 Drawing Sheets

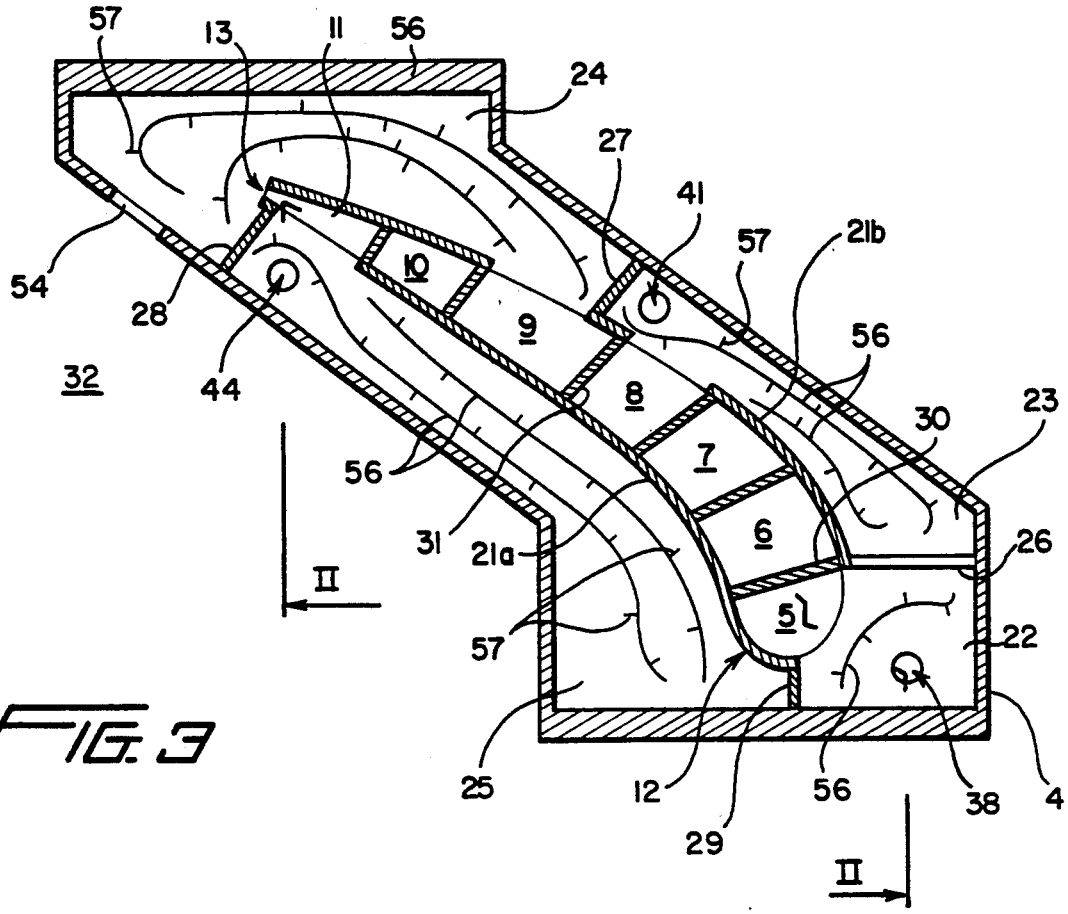
FIG. 3
FIG. 4
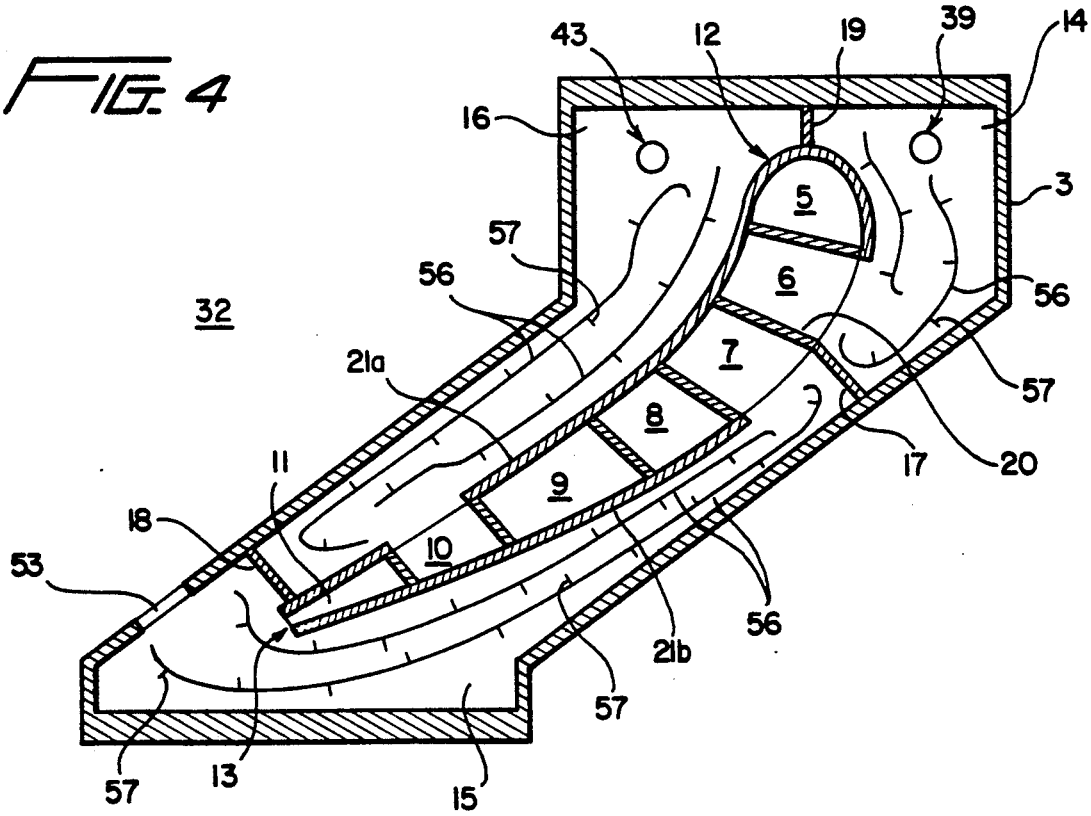

GUIDE VANE WITH A PLURALITY OF COOLING CIRCUITS

BACKGROUND OF THE INVENTION

The present invention relates to a guide vane for a gas turbine engine, more particularly such a guide vane which defines a plurality of cooling circuits to increase the cooling of the guide vane and to minimize pressure drops of the cooling fluid.

In order to increase the efficiency of a gas turbine engine, the gas temperatures at the exit end of the combustion chamber must be very high. The high temperature exhaust gases exiting from the combustion chamber come into contact with an array of guide vanes located immediately downstream of the combustion chamber exhaust which direct the hot gases onto the turbine stages of the gas turbine engine.

It is known to cool the array of guide vanes by passing a cooling fluid through the interiors of the vanes. The known cooled vanes define multiple cavities which are usually in communication with adjacent cavities such that the cooling fluid will pass sequentially through the cavities. Typically, this requires changes in direction of the cooling fluid of approximately 180°, thus generating substantial pressure drops in the cooling fluid which requires an increase in the cooling fluid circulation device.

SUMMARY OF THE INVENTION

A fluid cooled guide vane is disclosed for use in a gas turbine engine which defines a plurality of separate cooling circuits to guide a cooling fluid through the interior of the vane, while at the same time minimizing the pressure drop of the cooling fluid as it passes through the vane. Each cooling circuit has a cooling fluid inlet, a cooling fluid outlet, a cavity and a chamber which is in fluid communication with the cavity and either the fluid cooling inlet, or the fluid cooling outlet. The multiple chambers are located in mounting bases attached at either end of the vane. The mounting bases define the several chambers as well as the cooling fluid inlets. The cooling fluid outlets may either be defined by the mounting bases, or may be formed by rows of orifices through the vane wall in communication with the cavities within the vane.

The cooled guide vanes are usually arranged in an annular assembly such that each of the vanes extends generally radially with respect to the central axis of the annular array. The mounting bases may also comprise vane platforms which may attach the vanes together in the annular array, and which may also attach the annular array to the gas turbine engine structure.

In the fluid cooled guide vane according to the invention, the number of cooling fluid inlets is equal to the number of cavities defined by the vane. Also, each cavity is paired with a chamber and communicates with the chamber through an opening equal to the cross-section of the cavity so as to minimize the pressure drop in the cooling fluid as it passes between the cavity and the chamber. A pair of vane cavities communicate directly with the supply of cooling fluid through the mounting bases, one cavity through an outer mounting base and a second cavity through the inner mounting base.

The cooling fluid inlets, the cooling fluid outlets, the cavities and the chambers are arranged such that if the chamber is in direct communication with the cooling fluid inlet, the cavity is in direct communication with the cooling fluid outlet and vice versa so as to minimize the directional changes of the cooling fluid as it passes through each cooling circuit. Guide partitions may also be provided in each of the chambers so as to guide the flow of the cooling fluid either from a cooling fluid inlet, or towards a cooling fluid outlet. The guide partitions may also have turbulence producing extensions to introduce turbulence into the cooling fluid, thereby increasing the contact between the walls defining the chambers and cavities and the cooling fluid to thereby increase the cooling efficiency of the cooling fluid.

BRIEF DESCRIPTION OF THE DRAWINGS

FIG. 3 is a cross-sectional view taken along line III—III in FIG. 2.

FIG. 4 is a cross-sectional view taken along line IV—IV in FIG. 2.

DETAILED DESCRIPTION OF THE PREFERRED EMBODIMENT

Figure 1:
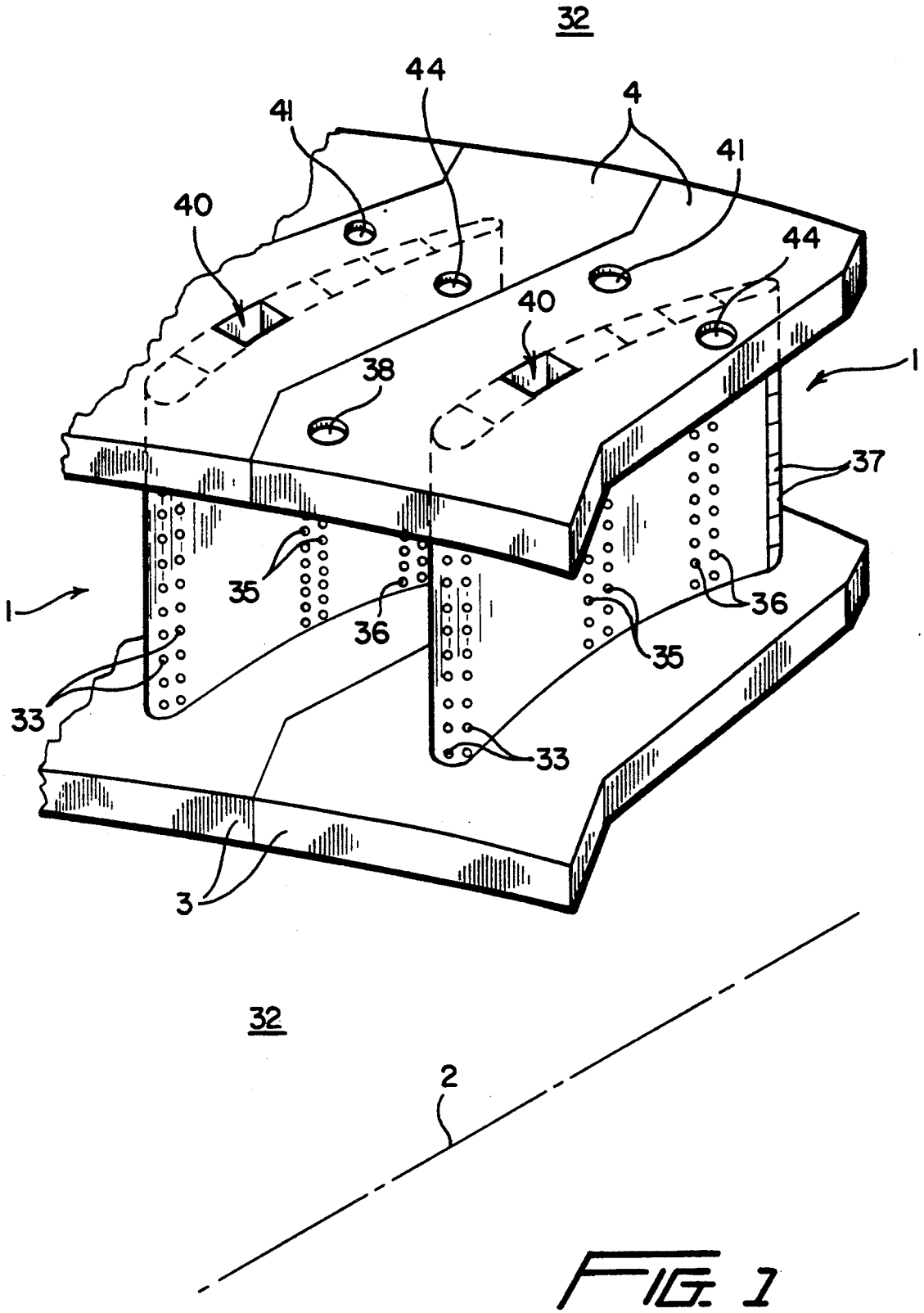
FIG. 1 is a partial, perspective view of a guide vane assembly including fluid cooled guide vanes according to the present invention.

FIG. 1 illustrates a portion of a guide vane assembly having vanes 1 extending substantially radially from central axis 2 of an annular array of vanes and having its opposite ends rigidly attached to an inner mounting base and an outer mounting base 4. The mounting bases 3 and 4 of each vane are located adjacent to each other so as to form an annular array extending about the axis 2. The inner mounting base 3 forms an inner mounting ring, while the outer mounting bases 4 form an outer mounting ring. The inner and outer mounting rings may be attached to the gas turbine engine structure (not shown) such that the vanes form a stationary guide vane assembly to direct hot gases emitted from the combustion chamber of the gas turbine engine onto the turbine stages. Since the vanes are located closely adjacent to the exhaust of the combustion chambers, they are continuously subjected to very high temperature gases. In order to withstand corresponding thermal stresses, the vanes and their mounting bases define a plurality of separate cooling circuits through which a cooling fluid, such as air, is circulated.

As can be seen in FIGS. 2-5, each vane 1 defines a plurality (in this particular instance seven) of cavities 5, 6, 7, 8, 9, 10 and 11, each of which extends through the blade. The series of cavities extend from the leading edge 12 of the vane to the trailing edge 13. Each of the cavities extends in a generally radial direction about the axis 2.

The inner mounting base 3 is attached to one end of the blade 1 and defines three cooling chambers, 14, 15 and 16. Chambers 14 and 15 are separated by partition 17 which generally is aligned with wall 20 which separates cavities 6 and 7. Similarly, partition 18 separates chambers 15 and 16 adjacent to the trailing edge 13 of the vane, while partition 19 separates chambers 14 and 16 and is located at the leading edge 12 of the vane 1. Each of the partition walls completely separates the chambers such that the chambers do not communicate with each other. As best seen in FIG. 4, the partition 18 is located adjacent to the trailing edge 13 of the vane on the pressure face 21*a*. Partition 19 is located at the leading edge 12 of the vane which separates the pressure face 21*a* from the suction face 21*b*.

The outer mounting base 4 is illustrated in FIG. 3 and defines four chambers 22, 23, 24 and 25. Chambers 22 and 23 are separated by partition 26 which generally forms an extension of wall 30 which separates cavities 5 and 6. Chambers 23 and 24 are separated by partition 27 which is located near wall 31 separating cavities 8 and 9, and which extends from the suction face 21*b*. Partition 28 separates chambers 24 and 25 adjacent to the trailing edge 13 of the vane 1 and is located on the pressure face 21*a* of the vane. Finally, partition 29 separates chambers 25 and 22 at the leading edge 12 of the vane 1. Partition 29 also separates the pressure face 21*a* from the suction face 21*b*. The total number of chambers is equal to the number of cavities.

Figure 2:
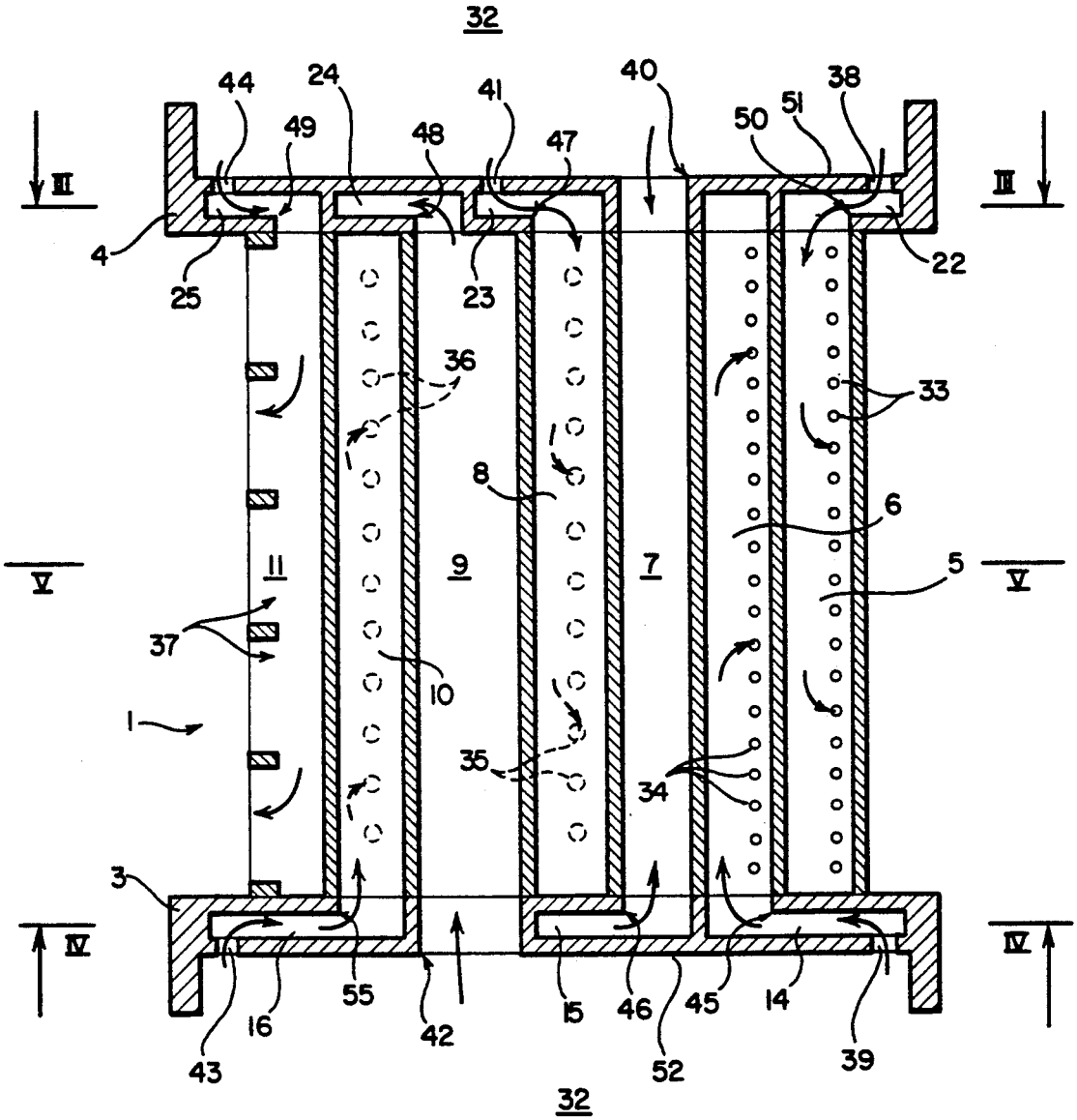
FIG. 2 is an axial cross-sectional view of the guide vane according to the present invention taken along line II—II in FIG. 3.
Figure 5:
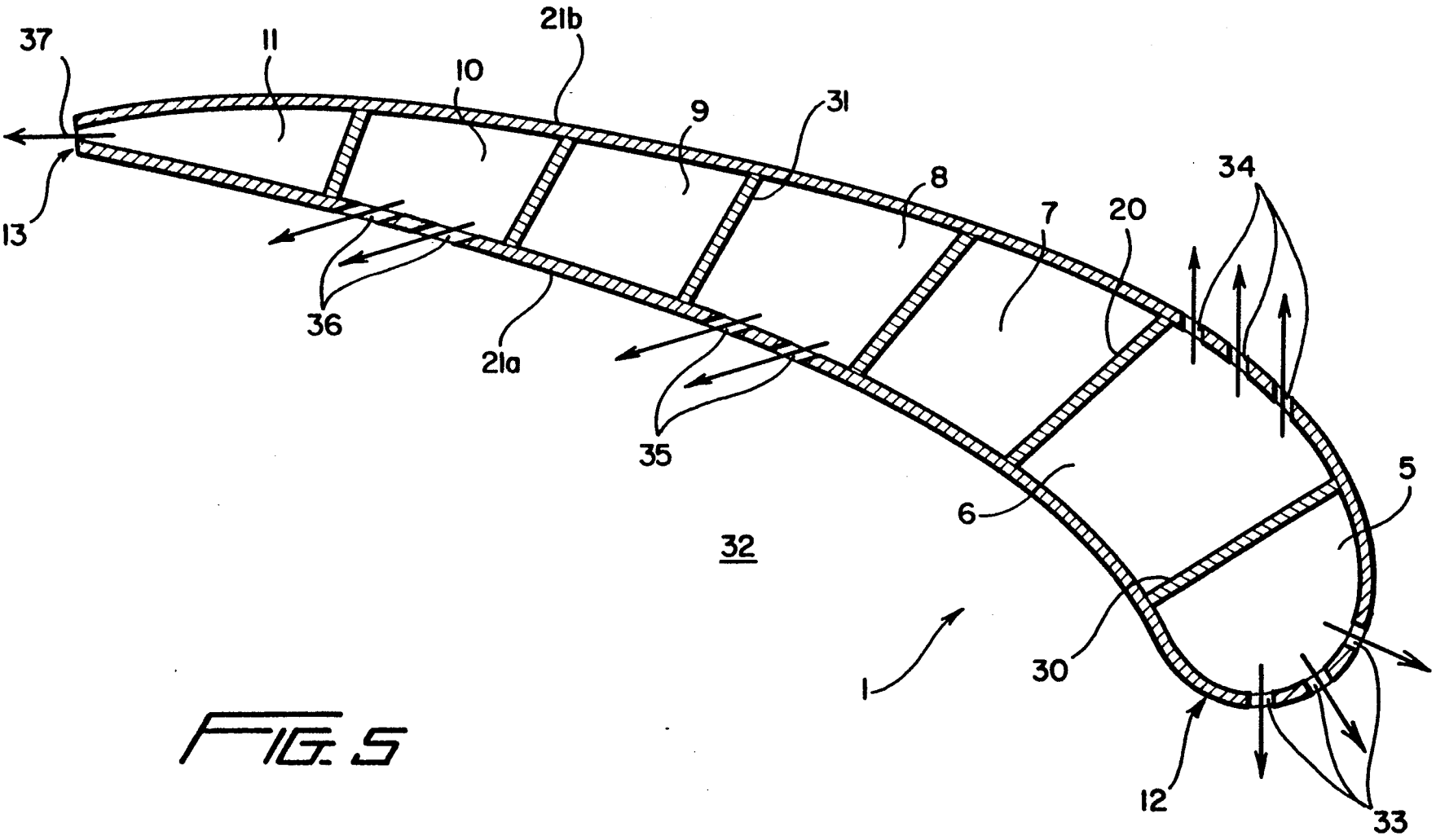
FIG. 5 is a cross-sectional view taken along line V—V in FIG. 2.

As best seen in FIGS. 1, 2 and 5 the leading edge 12 of the vane 1 defines a plurality of rows of fluid outlet orifices 33 which communicate directly with the cavity 5. The suction face 21*b* also defines a plurality of rows of fluid outlet orifices 34 which communicate directly with cavity 6. Pressure face 21*a* also defines a plurality of rows of fluid outlet orifices 35 which communicate directly with cavity 8, and a plurality of rows of fluid outlet orifices 36 which communicate directly with cavity 10.

The structure thus described establishes a plurality of separate cooling fluid circuits. The cooling fluid surrounding opposite ends of the vane structure, illustrated at 32 in FIG. 2, communicates with cavity 5 through cooling fluid inlet 38 defined by wall 51 in the outer mounting base 4. The cooling fluid passes through inlet 38, chamber 22 defined in outer mounting base 4, into cavity 5 through opening 50 and may exit from the cavity 5 through the outlet orifices 33. Opening 50 extends substantially across the cross-section of cavity 5. Cooling fluid 32 communicates with cavity 6 through cooling fluid inlet 39 defined by wall 52 of inner mounting base 3. The cooling fluid passes through the inlet 39, the chamber 14 and into cavity 6 via opening 45 extending across its cross-section. The cooling fluid may exit cavity 6 through the outlet orifices 34.

Cavity 7 communicates directly with the cooling fluid 32 through inlet 40 which is also defined by wall 51 of outer mounting base 4 and extends across the cross-section of cavity 7. The opposite end of cavity 7 communicates with chamber 15 via opening 46 such that the cooling fluid may pass into chamber 15 and may exit through cooling outlet 53 defined by the mounting base 3.

Cavity 8 communicates with chamber 23 via opening 47 which extends substantially across the entire cross-sectional area of the cavity 8. Cooling fluid 32 enters chamber 23 through cooling fluid inlet 41 defined by wall 51 and passes through chamber 23 into cavity 8. Cooling fluid exits cavity 8 through the outlet orifices 35.

Cavity 9 communicates directly with the cooling fluid 32 through cooling fluid inlet 42 defined by wall 52 of the mounting base 3. The opposite end of the cavity 9 communicates with chamber 24 via opening 48 such that cooling fluid may pass through the cavity 9, into the chamber 24 and may exit chamber 24 through cooling fluid outlet 54, best illustrated in FIG. 3. Openings 42 and 48 extend substantially across the cross-section of cavity 9.

Cooling fluid inlet 43 communicates with chamber 16 through wall 52 of the mounting base 3 to enable cooling fluid 32 to pass through chamber 16 into cavity 10. The cooling fluid may exit from cavity 10 through the cooling fluid outlet orifices 36. Cavity 10 communicates with chamber 16 through opening 55 which, again, substantially extends across the entire cross-section of the cavity 10.

Cooling cavity 11 communicates with chamber 25 via opening 49 such that cooling fluid passing into chamber 25 through cooling fluid inlet 44 defined by wall 51 will pass into the cooling cavity 11 and may exit therefrom through cooling fluid outlets 37 formed in the trailing edge of the vane 1.

As can be seen, each of the cooling fluid circuits is completely separate from the other cooling fluid circuits. In order to increase the cooling efficiency, the cooling fluid must flow through the cavities and chambers so as to dissipate the heat from the walls which are exposed to the high temperature gases. Therefore, the cooling fluid must flow along the walls and such cooling fluid flow should be turbulent so that it may satisfactorily sweep against the walls. Accordingly, the chambers 14–16 and 22–25 may further comprise guide partitions 56 (see FIGS. 3 and 4) to guide the fluid either from a cooling fluid inlet, or towards a cooling fluid outlet. Turbulence inducing protrusions 57 may extend from the guide partitions 56 to increase the turbulence in the cooling fluid flow. Similarly, the insides of cavities 5–11 may also be fitted with turbulence producing means, which have been omitted from the drawings for the sake of clarity.

A pressurized cooling fluid, such as air, is located in the space 32 externally of the mounting bases 3 and 4. This pressurized fluid used as a coolant directly enters the chambers 14, 16, 22, 23 and 25 through cooling fluid inlets 39, 43, 38, 41 and 44, respectively. It also directly enters the cavities 7 and 9 through cooling fluid inlets 40 and 42. As can be seen, the number of cooling fluid intake orifices is equal to the number of cooling cavities. Thus, seven separate cooling circuits are included in the vane according to the present invention. In each cooling circuit there are, at most, two sequential enclosures: chamber 22/cavity 5; chamber 14/cavity 6; cavity 7/chamber 15, chamber 23/cavity 8; cavity 9/chamber 24; chamber 16/cavity 10; and chamber 25/cavity 11. The use of separate cooling circuits each having only two distinct enclosures minimizes the pressure drops as the cooling fluid flows through each cooling circuit compared to the prior art devices in which three or more distinct enclosures are placed in sequential communication and which must be covered by the cooling fluid in sequence.

Furthermore, in the present structure, one of the enclosures (cavity and chamber) always directly communicates with the other such that the cooling fluid changes direction less than 180°. Again, this reduces the pressure drop in the cooling fluid flow, while also reducing the radial bulk of the vane assembly.

The flow in adjacent cavities may also be in counterflow directions which also enhances the temperature uniformity of the vane 1. As can be seen, cooling fluid flow takes place from the outer mounting base 4 towards the inner mounting base 3 in cavity 5 and flows generally in the opposite direction in adjacent cavity 6. Similarly, the cooling fluid flows from the mounting base 4 towards the mounting base 3 through the cavity 7 which is adjacent to cavity 6. Cooling fluid flows from the inner mounting base 3 towards the outer mounting base 4 through the cavity 10 in generally counterflow to the direction of cooling fluid flowing through adjacent cavity 11.

The foregoing description is provided for illustrative purposes only and should not be construed as in any way limiting this invention, the scope of which is defined solely by the appended claims.

We claim:

1. A fluid cooled guide vane assembly for a gas turbine engine, the assembly having a plurality of separate cooling circuits to guide a cooling fluid therethrough and comprising: a) a vane defining a plurality of cooling cavities each having a cooling fluid inlet opening and a cooling fluid outlet; and b) first and second mounting bases attached to the vane, each mounting base defining a plurality of non-communicating chambers such that one chamber communicates with one cavity through one of the inlet opening and the fluid outlet, such that the cooling fluid undergoes changes in direction of less than 180° during the flow through the cooling circuits.

2. The fluid cooled guide vane of claim 1 wherein each mounting base defines a plurality of cooling fluid base inlets such that each cooling fluid base inlet communicates with one chamber.

3. The fluid cooled guide vane of claim 1 wherein the cooling fluid outlets comprise a plurality of groups of fluid outlet orifices defined by the vane such that each group is in fluid communication with a one cavity.

4. The fluid cooled guide vane of claim 1 further comprising a guide partition located in at least one chamber so as to guide the cooling fluid flowing through the chamber.

5. The fluid cooled guide vane of claim 1 further comprising turbulence means located in at least one chamber so as to introduce turbulence into the cooling fluid flow to thereby increase the cooling effect of the cooling fluid.

* * * * *